US007370892B2

(12) United States Patent
Collingham

(10) Patent No.: US 7,370,892 B2
(45) Date of Patent: May 13, 2008

(54) SECURITY SEAL

(75) Inventor: James Collingham, Lancashire (GB)

(73) Assignee: ITW Limited, Berkshire Windsor (GB)

( * ) Notice: Subject to any disclaimer, the term of this patent is extended or adjusted under 35 U.S.C. 154(b) by 0 days.

(21) Appl. No.: 11/106,705

(22) Filed: Apr. 15, 2005

(65) Prior Publication Data

US 2006/0202489 A1 Sep. 14, 2006

(30) Foreign Application Priority Data

Mar. 8, 2005 (GB) ..... 0504776.6

(51) Int. Cl.
*G09F 3/03* (2006.01)
*E05B 39/02* (2006.01)

(52) U.S. Cl. ..... 292/329; 292/307 R; 292/328; 70/20; 70/50; 70/437; 24/704.1; 24/704.2

(58) Field of Classification Search ..... 292/307 R, 292/315, 317–321, DIG. 38, 327–329; 24/704.1, 24/704.2; 70/20, 50, 437, 439, 440
See application file for complete search history.

(56) References Cited

U.S. PATENT DOCUMENTS

| | | | | | |
|---|---|---|---|---|---|
| 88,959 | A | * | 4/1869 | Hopkins | 292/327 |
| 140,486 | A | * | 7/1873 | Dunn | 292/328 |
| 147,219 | A | * | 2/1874 | Ahrend | 292/328 |
| 306,524 | A | * | 10/1884 | Reeve | 292/329 |
| 380,446 | A | * | 4/1888 | Meise | 292/328 |
| 954,271 | A | | 4/1910 | Edgar | |
| 1,867,689 | A | * | 7/1932 | Van Leer | 70/50 |
| 1,937,743 | A | * | 12/1933 | Brooks | 292/328 |
| 1,948,255 | A | * | 2/1934 | Brooks | 292/328 |
| 2,655,805 | A | * | 10/1953 | Flectcher | 70/50 |
| 3,149,869 | A | | 9/1964 | Chamberlin | |
| 3,330,586 | A | * | 7/1967 | Becker | 292/315 |
| 3,372,952 | A | * | 3/1968 | Newton | 292/307 R |
| 3,380,267 | A | * | 4/1968 | Winchester | 70/232 |
| 3,591,223 | A | | 7/1971 | Castro Neto | |
| 4,082,336 | A | * | 4/1978 | Natkins | 292/318 |

(Continued)

FOREIGN PATENT DOCUMENTS

DE 341824 10/1921

(Continued)

OTHER PUBLICATIONS

Val-U-Mail, Issue One, *Tamper evident security seals secures pouches*—p. 2.

(Continued)

*Primary Examiner*—Carlos Lugo

(57) ABSTRACT

A security seal has a housing and a hasp moveable relative to the housing in a first direction between a locked position and a unlocked position. The hasp, in the locked position, is lockable to the housing by a disposable seal. The housing has an opening to allow the insertion of the disposable seal in a second direction different from the first direction. The hasp includes a first locking element engageable, in the locked position, with a second, matching locking element of the disposable seal to prevent movement of the hasp in the first direction toward the unlocked position and withdrawal of the disposable seal in the second direction. The hasp is attached to the housing so as to be both slidable and pivotable relative to the housing.

25 Claims, 9 Drawing Sheets

U.S. PATENT DOCUMENTS

Figure 1A:
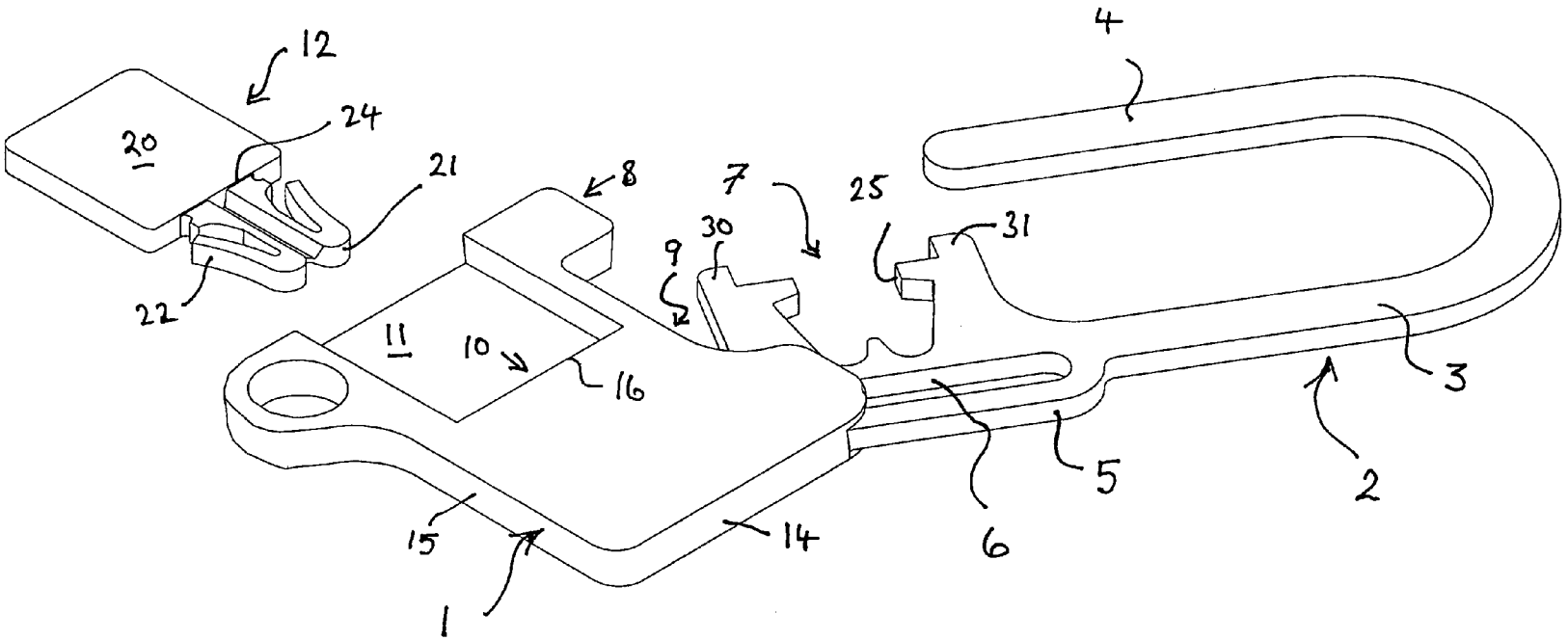

| | | | | |
|---|---|---|---|---|
| 4,106,801 | A | | 8/1978 | De Lima Castro Neto |
| 4,106,802 | A | | 8/1978 | Lozio |
| 4,175,782 | A | * | 11/1979 | de Lima Castro Neto ..... 292/307 R |
| 4,221,025 | A | * | 9/1980 | Martens et al. ..... 70/57.1 |
| 4,299,417 | A | * | 11/1981 | McClure ..... 292/320 |
| D264,766 | S | | 6/1982 | Huff |
| 4,342,477 | A | * | 8/1982 | McClure ..... 292/307 R |
| 4,505,503 | A | * | 3/1985 | LaMontagne ..... 292/315 |
| 4,512,599 | A | | 4/1985 | De Lima Castro Netto |
| D297,423 | S | | 8/1988 | Kong |
| 5,020,342 | A | * | 6/1991 | Doan et al. ..... 70/14 |
| 5,064,231 | A | * | 11/1991 | Mangone, Jr. ..... 292/319 |
| 5,230,541 | A | | 7/1993 | Nowak |
| 5,365,757 | A | * | 11/1994 | Primeau ..... 70/14 |
| 5,421,177 | A | * | 6/1995 | Sieber et al. ..... 70/57.1 |
| 5,522,627 | A | * | 6/1996 | Swift ..... 292/319 |
| 5,762,386 | A | * | 6/1998 | Fuehrer ..... 292/307 R |
| 5,782,513 | A | * | 7/1998 | Nazzari ..... 292/319 |
| D405,723 | S | | 2/1999 | Anscher |
| 6,511,108 | B1 | | 1/2003 | Roessner et al. |
| 6,533,335 | B2 | | 3/2003 | Hudson |
| 6,578,887 | B1 | * | 6/2003 | Kienzler ..... 292/321 |
| 6,749,235 | B1 | | 6/2004 | Crisp |
| 6,918,620 | B2 | * | 7/2005 | Crisp ..... 292/317 |
| 7,118,144 | B2 | | 10/2006 | Anderson |
| 2004/0012211 | A1 | * | 1/2004 | Burt ..... 292/327 |
| 2004/0047520 | A1 | | 3/2004 | Winpenny |
| 2005/0161958 | A1 | | 7/2005 | Graves |

FOREIGN PATENT DOCUMENTS

| | | | | |
|---|---|---|---|---|
| EP | 0223905 | | | 6/1987 |
| GB | 1424680 | | | 2/1976 |
| GB | 2025856 | | * | 1/1980 |
| GB | 2115354 | A | | 9/1983 |
| GB | 2364967 | A | | 2/2002 |
| GB | 2362430 | A | | 4/2007 |
| JP | 2000177753 | A | | 6/2000 |
| WO | 96/28804 | | | 9/1996 |
| WO | 97/48603 | | | 12/1997 |
| WO | 0186615 | A2 | | 11/2001 |
| WO | 02/16215 | | | 2/2002 |
| WO | 2004017280 | A1 | | 2/2004 |

OTHER PUBLICATIONS

Bond Mailroom Equipment, *Bond Arrowhead Plain Seals—Oct. 11, 2004, pp. 1 and 2 of 3. http://www.bondmailrooms.com/acatalog/Bond_*Arrowbead_Seals.html.

Royal, *Bag Seals*—Oct. 11, 2004, p. 1. http://royalpack.com/royal-pack/ingles/productostablai.asp.

EJ Brooks, *Safepak Security Bags & Safeseals*—Sep. 11, 2004, pp. 1-2. http://www.brokseals.com/catalog/product-detail.asp?ID=484.

Security Update, *Tamper Evident Protection*—p. 2.

The Partial Search Report for European Patent Application No. 06250799.1 from European Patent Office dated Aug. 1, 2006.

* cited by examiner

SECURITY SEAL

The present invention relates to a security seal of the padlock type. The seal has a housing which can receive the legs of a U- or J-shaped hasp.

EP-A-0223905 discloses a padlock-type seal which comprises a plastic housing having a pair of apertures for receiving a shackle formed of a U-shaped piece of wire. The shackle can be passed over the member to be locked and pushed into the housing, to irreversibly lock therein. The seal is released by cutting of the wire. This particular seal cannot be reused.

U.S. Pat. No. 5,230,541 discloses a seal which is in the form of a fastener for cabinets. The fastener is closed by means of a flexible, elongated band which engages on first and second latches within the fastener body. The band can be released for reuse.

WO-A-97/48603 discloses a padlock having a J-shaped hasp which may be locked in the padlock housing by means of a pressure sensitive catch. The hasp can also be locked by means of a two-part disposable seal having a protrusion which goes through a leg of the hasp. The padlock can be opened by one leg of the hasp being cut. A product based on the design of WO-A-97/48603 is manufactured and sold by ITW Envopak under the name "Padseal" (registered trade mark). This product has a J-shaped hasp with parallel arms which are inserted into slots within the seal housing. The arms are locked within the housing by means of a sprung catch. The hasp is removed by one leg being cut, the lower part of that leg then being pulled out of the bottom of the housing, which allows the remained of the hasp to be removed from the top.

Another padlock-type security seal is sold by Aluvin, a South African company, which seal includes a generally J-shaped hasp which is slidably fitted to a seal body by means of slot in the hasp locating over a pin in the body. The hasp is slid into the body to close the padlock, which is then locked in the closed position by means of a disposable seal engaging in a recess in the end of one arm of the hasp, the seal being inserted longitudinally of the hasp arm. To open the padlock, the seal is broken. The padlock can then be re-used with a fresh seal and because the seals are numbered the padlock is tamper-evident. A disadvantage of this padlock is that the pull resistance of the hasp is low, as any pull forces on the hasp will be transmitted in line to the seal, which could break at its built-in point of weakness. Thus accidental opening of the padlock may occur.

Disposable seals are well known for use with security envelopes. For example, an envelope with a zipped opening is described in GB-A-1424680. As described in this document, the disposable locking member (generally referred to as a "seal") has a head part, a "neck" and a body part. The head part goes through an aperture in the pull-tab of the zipper and engages in an aperture in the lock unit. The envelope is opened by removal of the body part of the seal, which causes rupture of the neck with the head part being left behind in the lock unit or envelope. Because the envelope can only be opened by breaking the locking member, a tamper evident seal to the envelope is provided. This same reference also discloses an envelope with a lock unit over which the pull-tab of the zipper fits, a seal being fitted into the lock unit from the side, on top of the pull-tab. This seal is a substantially flat element, having a body part and a head part substantially in the shape of an arrow-head with resilient barbs. A development of the tamper evident envelope and seal of GB-A-1424680 is disclosed in WO-A-02/16215.

It is one object of the invention to provide a padlock-type security seal of the above mentioned type which has an improved construction and/or performance.

According to a first aspect of the invention, there is provided a padlock-type security seal comprising a housing and a J-shaped hasp, the hasp being locked by a disposable seal having a body and a head separated by a line of weakness, the housing having first and second openings to receive the legs of the hasp, the longer leg of the hasp having a recess on its inside edge for receiving the head of a disposable seal and including means for engaging the head, the housing having a third opening which communicates with the opening for the said one leg of the hasp so as to allow insertion of the head of the disposable seal, the housing having a seat for the disposable seal, the third opening being laterally of the other openings such that the disposable seal is inserted transversely of the insertion direction of the hasp.

Because the hasp is J-shaped and the recess for the head of the seal is on the inside of the longer leg of the hasp, the body of the disposable seal when inserted will be at a position at the side of the longer leg and below the shorter leg of the hasp. This immediately provides for a convenient and compact design to the padlock-type security seal. Preferably the end of the body of the disposable seal is in line with or inside of the outer edge of the shorter leg of the hasp.

An edge of the third opening of the housing is adjacent the seat and forms an edge against which the seal is bent to break the seal along the line of weakness, and preferably the longer leg of the hasp extends laterally beyond the said bending edge and thus beyond the line of weakness of the disposable seal when the disposable seal is in its inserted position.

The padlock-type security seal can be closed in a tamper-evident fashion by means of a conventional disposable seal with an arrow-head shaped head. The barbs of the arrow-head in use engage behind lips of the recess in the hasp.

One advantage of the preferred embodiment of the invention is that the pull-resistance of the hasp is very high, because the hasp overlaps the body of the disposable seal beyond the line of weakness. This means that pulling on the hasp, accidental or deliberate, will result in a force which is transverse to the insertion direction of the disposable seal but displaced from the line of weakness. The pulling force acts across the body of the disposable seal, which is relatively strong, rather than at the line of weakness, so that inadvertent opening of the hasp by a load being placed on the padlock is avoided.

Preferably, the hasp extends at least 1 mm beyond the line of weakness of the disposable seal, so that the pull-forces are exerted through the seal body. The overlap could be from 1 to 15 mm, preferably 2 to 5 mm. It will be understood that this overlap corresponds to the distance the longer leg of the hasp extends beyond the aforementioned bending edge at the mouth of the opening for the seal.

According to another aspect of the invention, there is provided a disposable seal having a body and a head separated by a line of weakness, the head being formed of a pair of hook-shaped elements including resiliently flexible barbs, the barbs facing each other.

Preferably the outer edge of each hook-shaped element of the head is in line with the outer edge of the seal body. The outer edge of each barb may be formed with a notch.

This novel disposable seal can be used with the padlock-type security seal of the first aspect of the invention or with other known envelopes or containers which are closed by means of a seal locking into a lock chamber. The hasp or lock chamber as the case may be is correspondingly formed with a central protrusion/ridge which in use slots between the hook-shaped elements, the barbs then engaging behind forward edges of the protrusion. This protrusion can in particular be T-shaped or shaped like a hammer-head.

One advantage of the second aspect of the invention is that the seal has a high degree of tamper resistance, because the barbs which engage the hasp or protrusion/ridge of the lock chamber are on the inside of the seal, rather than the outside as with a conventional arrow-head. Furthermore, where the sides of the seal body and hook-shaped head are in line, security and tamper-resistance is further enhanced as it is very difficult to manoeuvre an implement (e.g. a pin) alongside the seal and into the recess holding the seal head.

Figure 1B:
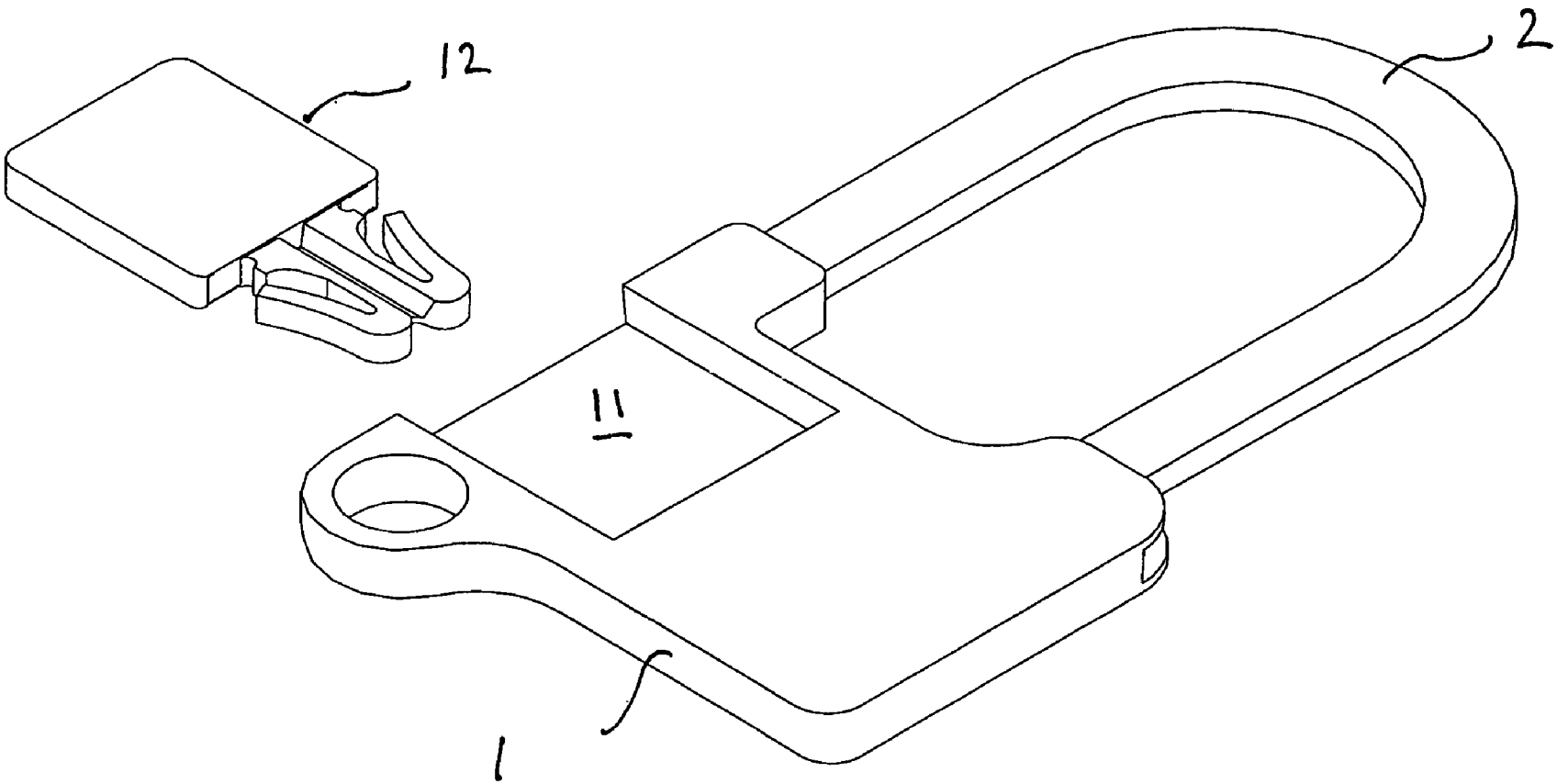
Figure 1C:
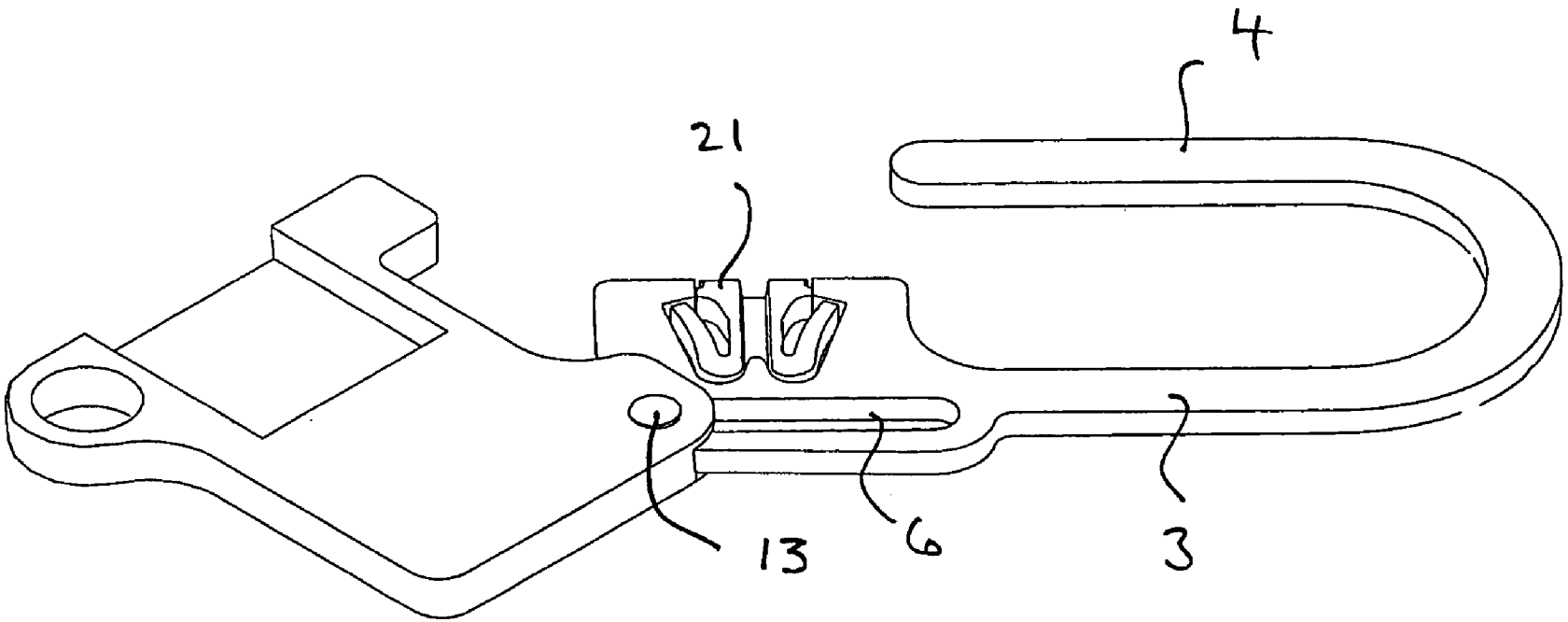
Figure 2:
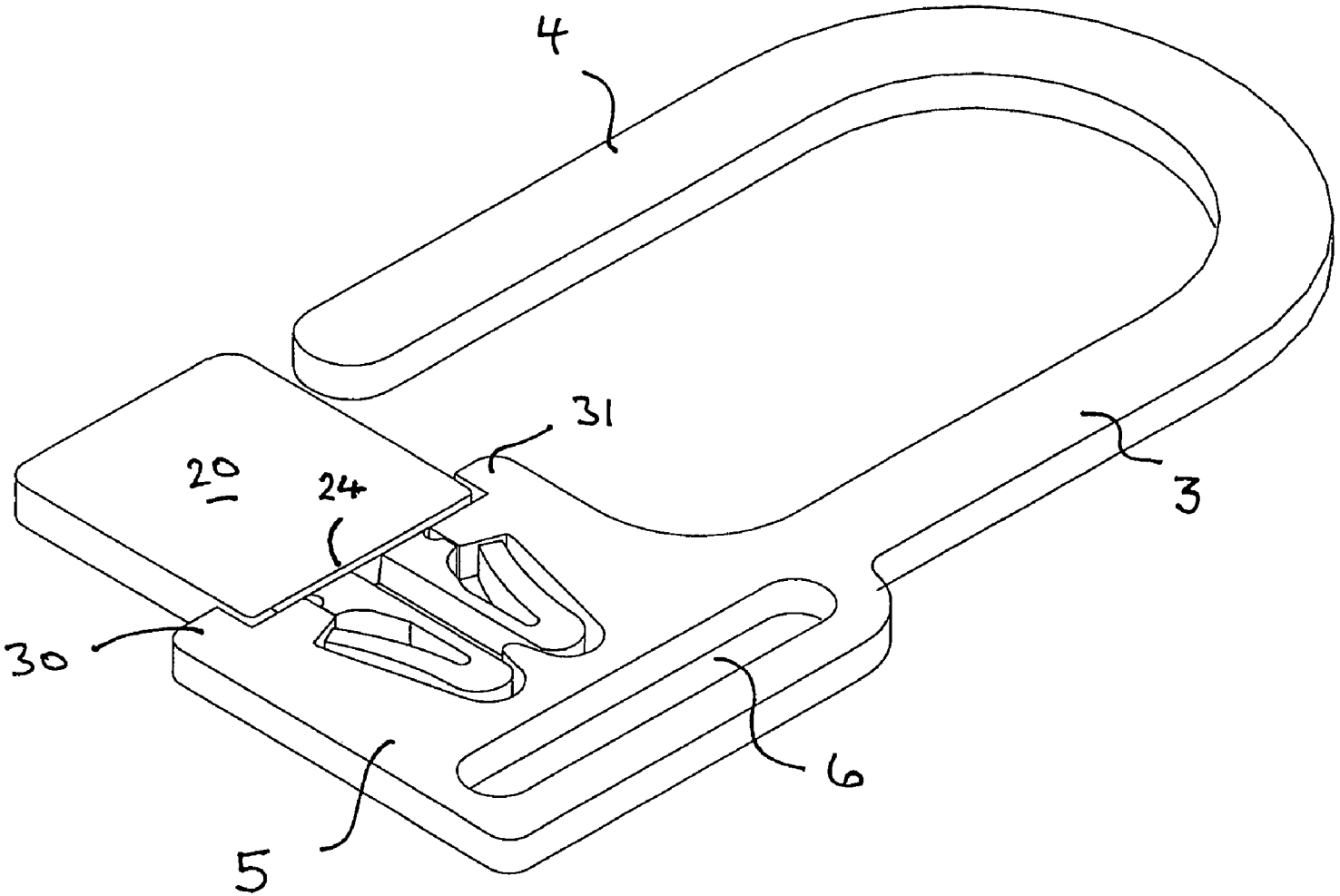
Figure 3A:
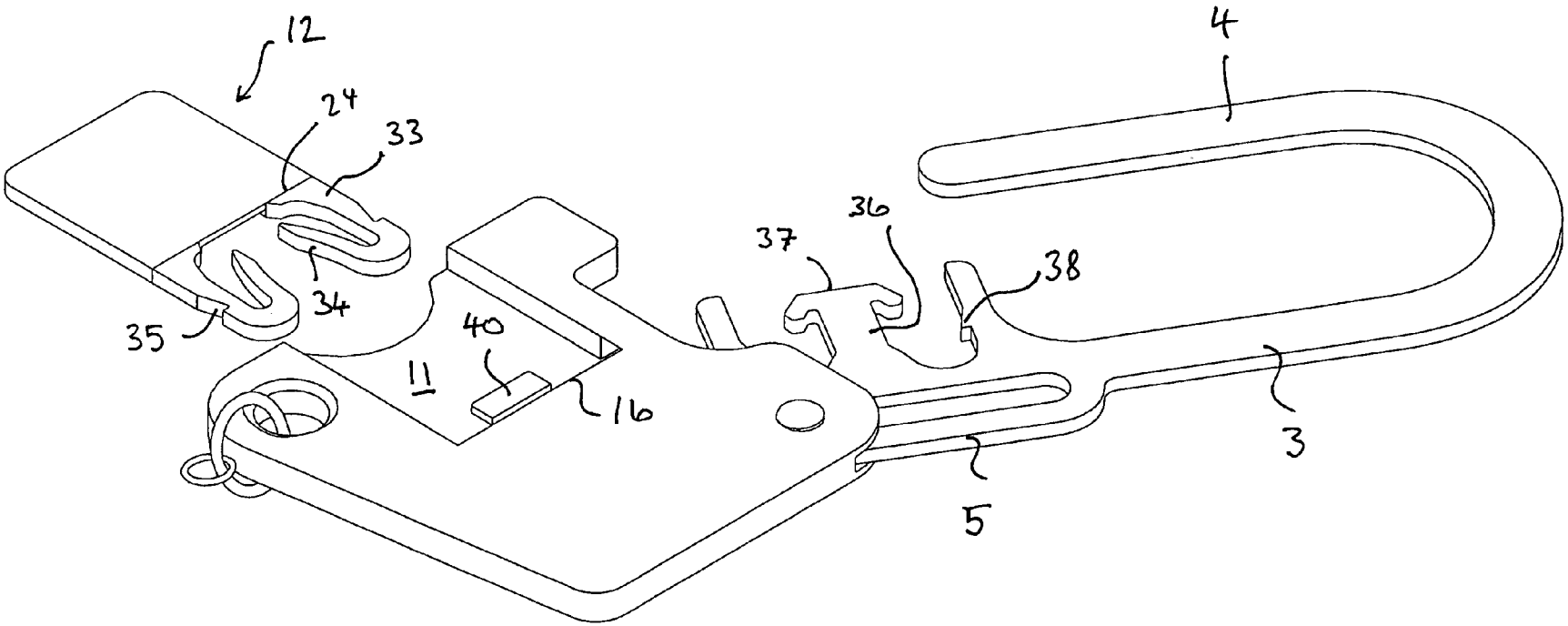
Figure 3B:
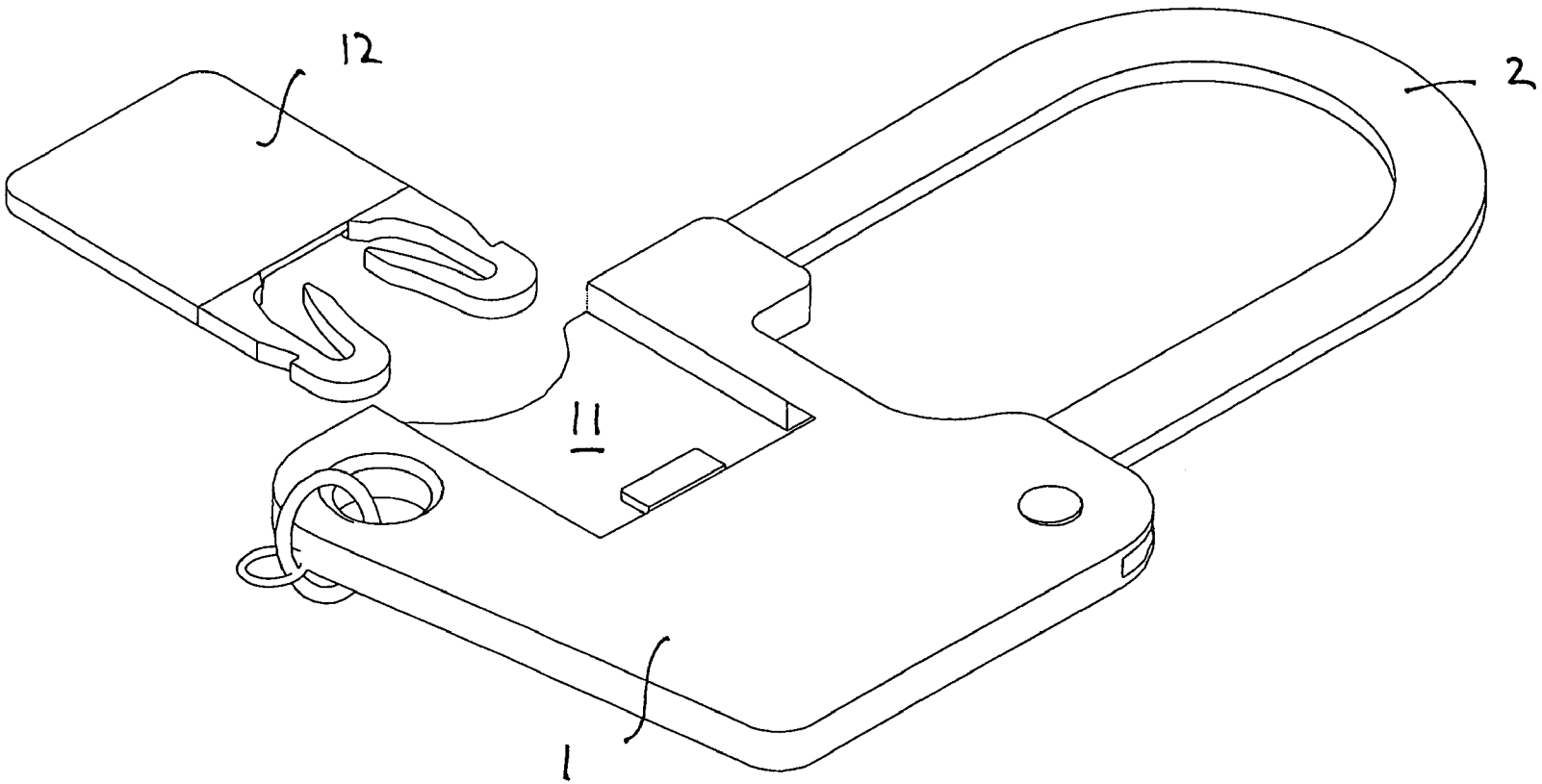
Figure 3C:
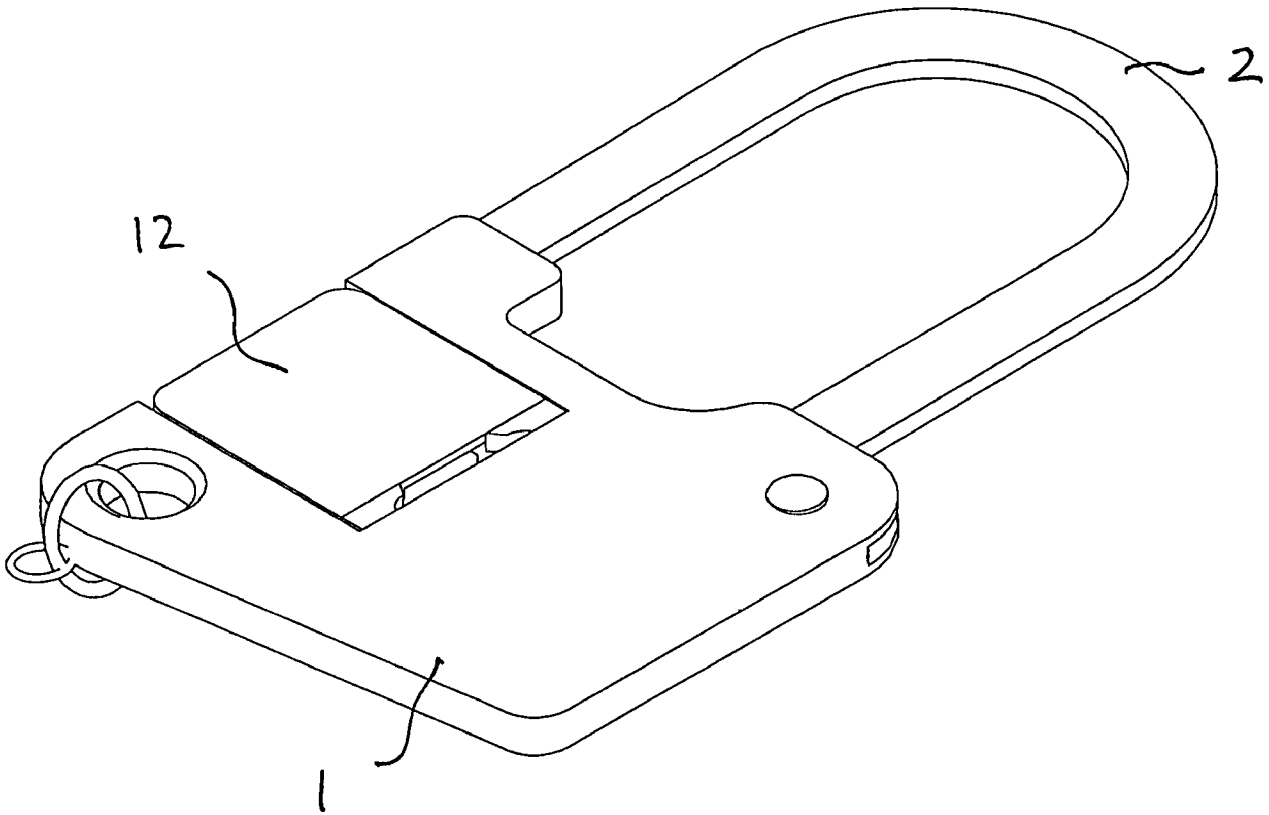
Figure 4:
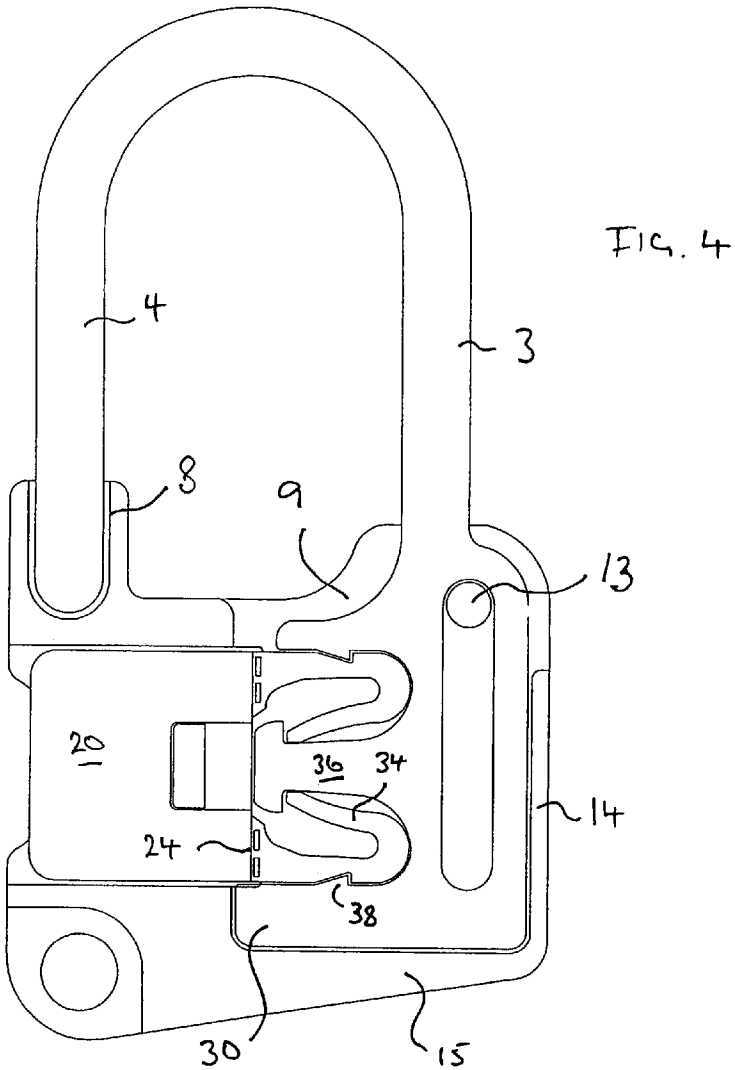
Figure 5:
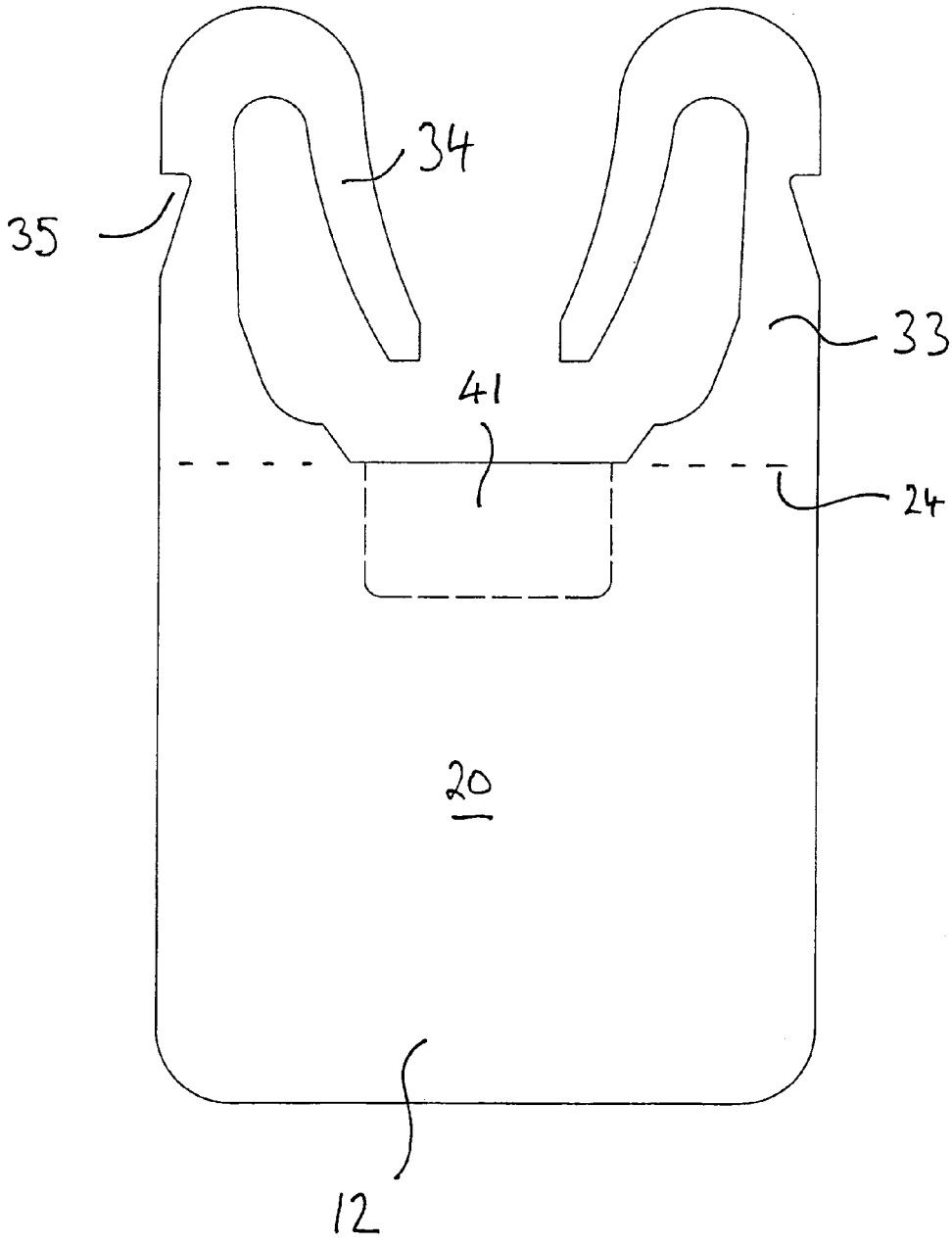

Further advantages of the invention will be understood from the following detailed description of preferred embodiments that the invention, which are described below, by example only, with reference to the accompanying figures. In the drawings:

FIGS. 1*a* to 1*c* show a perspective view of a first embodiment of the invention, the figures showing the closing and opening sequence for the padlock type security seal in use;

FIG. 2 is a perspective view of the disposable seal and hasp of the padlock of FIGS. 1*a* to 1*c*, but without the padlock body in order to show the fitting of the seal in the hasp;

FIGS. 3*a* to 3*c* are views similar to FIGS. 1*a* to 1*c*, showing a second embodiment of the invention with a different disposable seal;

FIG. 4 is a horizontal sectional view of the padlock and seal as seen in FIG. 3*c*, showing the fitting of the hasp in the padlock body and the disposable seal in the hasp; and FIG. 5 is a plan view of the disposal seal used in the embodiment of FIGS. 3*a* to 3*c*.

The padlock type security seal of the invention will hereinafter be referred to as a "padlock" for ease of reference and understanding. The padlock of FIGS. 1*a* to 1*c* includes a padlock body 1 and a hasp 2. The hasp 2 is generally J-shaped with two parallel arms 3, 4, a longer leg 3 and a shorter leg 4. At the end of arm 3 there is an enlarged head portion 5 which includes a generally elongate slot 6 and a recess 7. The slot 6 is parallel to arms 3 and 4. Recess 7 opens out to the side of head portion 5, so that a disposable seal can be introduced transversely of the hasp, as discussed below. The recess 7 opens to the inside of the hasp, i.e. towards the arm 4.

The padlock body 1 has a first slot 8 which can receive the end of arm 4 of the hasp 2 and a second slot 9 which can receive the head 5 of arm 3 of the hasp. Slot 9 in the padlock body has an opening 10 at its side which registers with the recess 7 of the hasp when it is inserted in the padlock body. The opening 10 is adjacent a seat 11 formed on the padlock body for receiving a disposable seal 12.

The hasp 3 is preferably connected to the padlock body by means of a pin 13 at the top of the slot 9, this pin being fixed to the padlock body and being located in slot 6 of the hasp. The slot 6 allows the hasp to slide in and out of the padlock body and in particular allows the padlock to be unlocked without complete separation (and possible loss) of the hasp.

In this embodiment, slot 8 in the padlock body is in the form of a blind bore. Slot 9 is defined by a side wall 14 and bottom wall 16 of the hasp body, together with the front and back of the padlock body. The hasp 3 is typically formed as a thin, flat member, for example of steel. The padlock body is typically formed from two moulded plastics halves, welded together in a conventional fashion (with the pin 13 locating in the slot 6 of the hasp). The material of the padlock body might be formed of Nylon, glass-filed Nylon, ABS, Acrylic, Polycarbonate or an appropriate metal.

The disposable seal 12 of the embodiment of FIGS. 1*a* to 1*c* is a conventional seal of the type shown in GB-A-1424680 and WO-A-02/16215. The seal includes a body part 20 and a head part 21, the head part 21 being arrow-shaped with barbs 22. The disposable seal 12 is formed of a resilient plastics material, for example Polystyrene or Acetal, so that the barbs 22 can flex inwardly. Between the head 21 and body 20 of the disposable seal there is a neck portion 23 having a line of weakness 24. The head 21 of the disposable seal is sized so as to locate within the recess 7 of hasp 3. It should be noted that the side opening of recess 7 is narrowed, lips 25 being formed at the mouth of recess 7 (see FIG. 2).

The way in which the padlock of FIGS. 1*a* to 1*c* is used will now be explained. In a first step, the hasp 3 is slid into the padlock body 1, pin 13 travelling along slot 6 and arms 3 and 4 of the hasp locating in slots 9 and 8 respectively of the padlock body. This position is shown in FIG. 1*b*.

To lock the padlock, the disposable seal 12 is now pushed into the side of the padlock body, so that head 21 locates within the recess 7 of the hasp and the body 20 of the seal locates on a seat 11 of the padlock body. It should be noted in particular that the barbs 22 of the head of the disposable seal are squeezed inwardly upon insertion of the seal and then spring outwardly again once the head 22 is located in the recess, the barbs 22 then locating behind lips 25. This position is shown in FIG. 2. For the purposes of clarity, FIG. 2 shows the combination of the hasp 3 and disposable seal 20, but without the padlock body.

It will be understood that because the hasp is J-shaped and the recess for the head of the seal is on the inside of the longer leg 3, the body of the disposable seal when inserted will be at a position at the side of the longer leg 3 and below the shorter leg 4 of the hasp. This enables a convenient and compact design to the padlock-type security seal. Preferably the end of the body 20 of the disposable seal is in line with or inside of the outer edge of the shorter leg of the hasp 3 (as most clearly seen in FIG. 4). This means that the length of the body 20 of the disposable seal would be the same as or less than the length of the seat 11.

A further important aspect of the present invention is now described. As shown in FIG. 1*a* and FIG. 2, the head 5 of arm 3 of the hasp has a lug 30 which extends laterally, so that in use this lug 30 locates beneath the forward part of the body 20 of the disposable seal. Conveniently, there is a similar lug 31 at the other side of the recess 7 in head 5 of the hasp so that the width of the head 5 is the same at the top and the bottom, which aids the sliding movement into and out of the padlock body. Because part of the hasp locates over the side of the body 20 of the disposable seal, the line of weakness 24 of the disposable seal is in effect inside the head of the hasp. This means that pulling of the hasp will not tend to break the seal at its line of weakness. On the contrary, pull forces are applied to the strongest part of the disposable seal, namely the body.

The overlap of the head of the hasp beyond the break-line of the seal is preferably at least 1 mm beyond the line of weakness of the disposable seal. The overlap could be from 1 to 15 mm, preferably 2 to 5 mm.

The overall dimensions of the seal are typically about 22 mm long by 1 mm wide by 2.5 mm thick. The thickness of the head is typically 2.0 mm.

Opening of the padlock is achieved by lifting the body 20 of the disposable seal away from the seat 11 of the padlock body. This forces the seal to bend against edge of the padlock body, at the mouth of recess 7. This action will break the disposable seal along the line of weakness 24. With the seal body 20 disconnected from the seal head 21, the hasp can be pulled out and whatever item the padlock is locking is then released. FIG. 1*c* shows the hasp removed form the padlock body, with the broken head of the disposable seal inside the hasp. It can be noted that FIG. 1*c* shows a version of the hasp without lug 30.

With the hasp pulled out of the padlock body, the head 22 of the disposable seal will fall out of the recess 7 (or can be shaken out as the case may be). For the avoidance of any doubt, while the open back and front of the recess 7 of the head of the hasp allow easy removal of the head 22 of the disposable seal, when the hasp is inserted into the padlock the recess is of course closed at the front and the back by the front and rear of the padlock body. Thus, tampering with the disposable seal is prevented.

The embodiment of FIGS. 3*a* to 3*c* is similar to that of FIGS. 1*a* to 1*c*, except that a different geometry to the head 5 of the hasp and to the disposable seal is used. In this embodiment like numerals are used to identify like parts, as compared to the first embodiment.

The disposable seal is shown in isolation in FIG. 5. Rather than an arrow-head shaped head part to the disposable seal, the seal instead has two "fish-hook" head parts 33, each with a barb 34. The hook-shaped head parts 33 are formed so that the barbs 34 face inwardly, and preferably the head parts 33 are at the side of the disposable seal, so that the edge of the body 20 of the disposable seal and the outer edge of the hook-shaped head part 33 are in line. On the outside of each hook-shaped head part 33 is formed a notch 35.

The recess 7 of the head part 5 of the hasp 2 is shaped so as to receive this alternative form of the head of the disposable seal. In particular, as shown most clearly in FIG. 3*a*, the recess 7 is divided by a T- or hammer-head shaped projection 36, the outward edge 37 of which in use rests alongside the forward edge of the body 20 of the disposable seal 12, between the head parts 33. In use, the barbs 34 will pass over the edges of the T- or hammer-shaped portion 36 and then locate behind the said portion.

The sides of the recess 7 are formed with triangular projections 38 which engage in the notches 35 of the disposable seal.

The sectional view of FIG. 4 shows the position of the seal in the padlock, as seen in FIG. 3*c*. FIG. 4 shows clearly the forward end 30 of the hasp head 5 which extends laterally, so that in use this end or nose 30 locates beneath the forward part of the body 20 of the disposable seal. Conveniently, there is a similar end or nose 31 at the other side of the recess 7 in head 5 of the hasp, as seen in FIG. 3*a*, so that the total width of a head 5 is the same at the top and the bottom, which aids the sliding movement into and out of the padlock body. However, this is not essential and FIG. 4 shows that the head part 5 of the hasp 2 can be narrower above the recess 7 than below. As with the first embodiment, because part of the hasp (end 30) locates over the side of the body 20 of the disposable seal, the line of weakness 24 of the disposable seal is in effect inside the head of the hasp. This means that pulling of the hasp will not tend to break the seal at its line of weakness. On the contrary, pull forces are applied to the strongest part of the disposable seal, namely the body.

The closing and opening sequence for the padlock of FIGS. 3*a* to 3*c* is essentially the same as that of the padlock of FIGS. 1*a* to 1*c*. For both embodiments, it can be noted that the edge 16 (see FIGS. 1*a* and 3*a*) of the padlock body 1, at the inner edge of the seat 11, is set back slightly with respect to the leading edge of the head 5 of the hasp 2, so that when the disposable seal 12 is lifted the bending forces on the disposable seal against the padlock body occur substantially along the line of weakness 24 of the disposable seal. In other words, the edge 16 of the third opening 10 of the padlock body is adjacent the seat 11 and forms an edge against which the seal is bent to break the seal along the line of weakness, and the leg 3 of the hasp extends laterally beyond the this bending edge with a given overlap as previously stated (1 to 15 mm, preferably 2 to 5 mm).

As seen if FIGS. 3*a* and 3*b*, the seat 11 of the padlock body may have a centering projection 40 which in use registers with a recess 41 on the underside of the seal 12. Furthermore, the seat 11 of the padlock bottom can be recessed at its outer edge, to facilitate lifting of the disposable seal (i.e. the body of the seal extends over the recessed part as shown in FIG. 4).

Although the seal of FIG. 5 has been illustrated for use with a padlock type security seal, it should be emphasized that this disposable seal has a novel geometry and provides advantages when used in connection with other products which are to be closed in a tamper evident fashion. For example, the seal can be used with zipped security envelopes where the seal overlies the zip puller tab and then locates in a lock chamber (see for example GB-A-1424680) or in a different type of container or envelope where a flap closes over a lock chamber and the seal is inserted in the lock chamber, so as to lie on top of part of that flap. In such products the lock chamber will be formed with a central ridge or protrusion will in use will locate between the head parts of the seal of FIG. 5, the barbs of the seal locating behind part of this ridge or protrusion. As will be understood, opening of the envelope or container is prevented until such time as the seal is broken.

The invention claimed is:

1. A security seal, comprising a housing and a hasp moveable relative to said housing in a first direction between a locked position and a unlocked position;

said hasp, in the locked position, being lockable to said housing by a disposable seal;

said housing having an opening allowing insertion of the disposable seal in a second direction different from the first direction; and said hasp including a first locking element engageable, in the locked position, with a second, matching locking element of the disposable seal to prevent movement of said hasp in the first direction toward the unlocked position and withdrawal of said disposable seal in the second direction, wherein:

said hasp further includes a portion which, in the locked position, is received in said housing, extends in the second direction across an edge of said opening, and is adapted to engage the disposable seal beyond both sides of a line of weakness adapted to be arranged along the edge of said opening, thereby minimizing the possibility of undesirable failure of the line of weakness of the disposable seal when said hasp is pulled in the first direction away from the locked position.

2. The security seal according to claim 1, wherein said portion of the hasp extends at least 1 mm on each side of the edge of said opening.

3. The security seal according to claim 1, further comprising said disposable seal having a body, the second locking element, and said line of weakness separating said body from the second locking element, the second locking element comprising an arrow-head shaped head with barbs engageable with the first locking element of said hasp.

4. The security seal according to claim 1, further comprising said disposable seal having a body, the second locking element, and said line of weakness separating said body from the second locking element, the second locking element comprising a pair of hook-shaped, resiliently flexible barbs, the barbs facing each other.

5. The security seal of claim 1, wherein the first direction is substantially perpendicular to the second direction.

6. The security seal of claim 1, wherein said hasp is J-shaped and comprises a longer leg and a shorter leg;

said housing comprising further openings for receiving the legs of said hasp;

said longer leg comprising a recess, which defines said first locking element, for receiving and engaging the second locking element of the disposable seal;

the opening for the disposable seal communicating with the opening for the longer leg and being laterally of the openings for the legs.

7. The security seal of claim 6, wherein said housing further comprises a seat for a body of the disposable seal, said seat being located on an imaginary extension of the opening for the shorter leg which is a blind bore.

8. The security seal according to claim 1, further comprising said disposable seal having a body, the second locking element, and said line of weakness separating said body from the second locking element;

wherein said portion of said hasp when said hasp is locked in the locked position by said disposable seal, is received in said housing, extends across the line of weakness of said disposable seal, and engages a portion of said body of the disposable seal on both sides of the line of weakness, thereby minimizing the possibility of undesirable failure of the line of weakness of the disposable seal when said hasp is pulled in the first direction away from the locked position.

9. The security seal according to claim 8, wherein, when said hasp is locked in the locked position by said disposable seal, the line of weakness of said disposable seal is arranged along an edge of said opening, said edge defining a folding guide for folding and breaking said disposable seal along said line of weakness.

10. The security seal according to claim 8, wherein said portion of said hasp extends from about 1 mm to about 15 mm on each side of said line of weakness.

11. The security seal according to claim 8, wherein said portion of said hasp extends from about 2 mm to about 5 mm on each side of said line of weakness.

12. The security seal according to claim 1, further comprising said disposable seal having a body, the second locking element, and said line of weakness separating said body from the second locking element;

wherein said hasp comprises a recess, which defines said first locking element, for receiving and engaging the second locking element of the disposable seal; and wherein, when said hasp is locked in the locked position by said disposable seal, the line of weakness is completely located in said recess, thereby minimizing the possibility of undesirable failure of the line of weakness and enhancing pull resistance of said security seal.

13. The security seal according to claim 1, further comprising:

a slot formed in said hasp; and a pin which is moveably retained by said slot formed in said housing, thereby allowing both sliding and pivotal movement of said hasp relative to said housing in said unlocked position.

14. The security seal according to claim 13, wherein said slot is formed in said hasp and, in the locked position, said slot is completely inside said housing.

15. The security seal according to claim 1, wherein said disposable seal having a body, the second locking element, and the line of weakness separating said body from the second locking element; and said portion of said hasp includes a projection which, when said hasp is locked in the locked position by said disposable seal, extends transversely of and away from the line of weakness and towards the body of said disposable seal thereby minimizing the possibility of undesirable failure of the line of weakness of the disposable seal when said hasp is pulled away from the locked position in the first direction.

16. A security seal, comprising:

a housing;

a hasp moveable relative to said housing between a locked position and a unlocked position and having a first locking element at an end thereof; and a disposable seal insertable into said housing and having a body, a second locking element, and a line of weakness separating said body from the second locking element, said second locking element is the forward-most part of said disposable seal;

wherein said hasp is lockable in the locked position to said housing by said disposable seal with the first locking element of said hasp engaging the second locking element of said disposable seal; and wherein said end of said hasp includes a projection which, when said hasp is locked in the locked position by said disposable seal, extends transversely of and away from the line of weakness and towards the body of said disposable seal, thereby minimizing the possibility of undesirable failure of the line of weakness of the disposable seal when said hasp is pulled away from the locked position.

17. The security seal according to claim 16, wherein said disposable seal is breakable along the line of weakness into more than two parts.

18. The security seal according to claim 16, wherein, when said hasp is locked in the locked position by said disposable seal, said projection of the hasp extends at least 1 mm on each side of the line of weakness.

19. The security seal according to claim 16, wherein the second locking element comprises an arrow-head shaped head with barbs engageable with the first locking element of said hasp.

20. The security seal according to claim 16, wherein the second locking element comprises a pair of hook-shaped, resiliently flexible barbs, the barbs facing each other.

21. The security seal according to claim 16, wherein in the locked position, said projection engages a portion of said body of the disposable seal in a second direction transverse to a first direction in which said hasp is pulled away from the locked position, thereby preventing undesired movement of said hasp in said first direction.

22. The security seal according to claim 21, wherein said second direction is perpendicular to the first direction.

23. The security seal according to claim 16, wherein, in the locked position, the line of weakness is exposed for facilitating breaking of said disposable seal when the body of the disposable seal is bent about said line of weakness.

24. A method of providing evidence of potential tampering with a security seal comprising a housing, a hasp and a disposable seal, said method comprising:

introducing the hasp, in a first direction, in the housing until the hasp reaches a locked position; and inserting the disposable seal, in a second direction angled relative to the first direction, into the housing until the disposable seal engages the hasp in the locked position, thereby preventing withdrawal of both the hasp and the disposable seal from the housing wherein, said disposable seal is entirely disposed in the housing in said locked position, wherein the hasp has, at an end thereof, a first locking element and a projection;

the disposable seal has a body, a second locking element, and a line of weakness separating said body from the second locking element; and said method further comprises engaging the second locking element of the disposable seal with the first locking element of the hasp in the locked position with the projection of the hasp extending across the line of weakness of the disposable seal, thereby minimizing the possibility of undesirable failure of the line of weakness of the disposable seal when the hasp is pulled away from the locked position.

25. The method according to claim 24, further comprising:

breaking the disposable seal at the line of weakness to separate the second locking element from the body; and withdrawing the hasp and the separated second locking element from the housing.

* * * * *